US010399809B2

(12) United States Patent
Montoya et al.

(10) Patent No.: US 10,399,809 B2
(45) Date of Patent: Sep. 3, 2019

(54) ROLLED MATERIAL TENSIONING AND LOADING SYSTEM

(71) Applicant: NIKE, Inc., Beaverton, OR (US)

(72) Inventors: Adam Montoya, Shepherdsville, KY (US); Stephen Hancock, Wake Forest, NC (US)

(73) Assignee: NIKE, Inc., Beaverton, OR (US)

( * ) Notice: Subject to any disclaimer, the term of this patent is extended or adjusted under 35 U.S.C. 154(b) by 104 days.

(21) Appl. No.: 15/365,391

(22) Filed: Nov. 30, 2016

(65) Prior Publication Data

US 2017/0152120 A1 Jun. 1, 2017

Related U.S. Application Data

(60) Provisional application No. 62/261,699, filed on Dec. 1, 2015.

(51) Int. Cl.
*B65H 23/182* (2006.01)
*B65H 23/185* (2006.01)
(Continued)

(52) U.S. Cl.
CPC ..... *B65H 23/1825* (2013.01); *B65H 19/126* (2013.01); *B65H 23/0326* (2013.01);
(Continued)

(58) Field of Classification Search
CPC .... B65H 23/00; B65H 23/005; B65H 23/032; B65H 23/0326; B65H 23/04;
(Continued)

(56) References Cited

U.S. PATENT DOCUMENTS 2,487,755 A 11/1949 Few
4,437,619 A 3/1984 Cary et al.
(Continued)

FOREIGN PATENT DOCUMENTS

CN 1231251 A 10/1999
DE 102009042019 A1 3/2011
(Continued)

OTHER PUBLICATIONS

International Search Report and Written Opinion dated Mar. 20, 2017 in International Patent Application No. PCT/US2016/064372, 16 pages.

(Continued)

*Primary Examiner* — Michael R Mansen
*Assistant Examiner* — Raveen J Dias
(74) *Attorney, Agent, or Firm* — Shook Hardy & Bacon, LLP

(57) ABSTRACT

Maintaining a level of tension on material as it is processed in a manufacturing operation assists in the processing of the material. The tension of the material as it is fed through a process station is maintained by a material sag portion, such as an unsupported portion of the material extending between a roll of the material and the process station. The formation of the sag portion and the loading of the material forming the sag portion are automated and adjusted with a system having a material storage retrieval system, a shuttle, a tensioning device, and/or a processing station.

11 Claims, 11 Drawing Sheets

(51) Int. Cl.
*B65H 23/04* (2006.01)
*B65H 23/032* (2006.01)
*B65H 19/12* (2006.01)

(52) U.S. Cl.
CPC ..... *B65H 23/042* (2013.01); *B65H 23/182* (2013.01); *B65H 23/185* (2013.01); *B65H 2402/32* (2013.01); *B65H 2515/31* (2013.01)

(58) Field of Classification Search
CPC .... B65H 23/042; B65H 23/046; B65H 23/18; B65H 23/182; B65H 23/1825; B65H 23/185; B65H 19/126; B65H 19/10; B65H 49/38; B65H 2402/32; B65H 2405/422; B65H 2405/4221; B65H 2405/44; B65H 23/192; B65H 23/1888; B65H 23/0328; B65H 19/12
USPC ..... 242/418, 418.1, 420.6
See application file for complete search history.

(56) References Cited

U.S. PATENT DOCUMENTS

| | | | | | |
|---|---|---|---|---|---|
| 4,611,799 | A * | 9/1986 | Nuttin | B41F 13/54 | 101/226 |
| 4,805,111 | A | 2/1989 | Steidel | | |
| 4,805,847 | A * | 2/1989 | Schonmeier | B65H 18/08 | 226/92 |
| 5,751,298 | A * | 5/1998 | Crowley | B65H 5/025 | 271/265.01 |
| 6,440,268 | B1 * | 8/2002 | Baggot | B65H 16/10 | 162/109 |
| 6,722,606 | B2 * | 4/2004 | Hanson | B65H 16/103 | 242/554.6 |
| 7,546,971 | B2 * | 6/2009 | Pappas | B65H 19/123 | 242/533.7 |
| 2013/0223899 | A1 * | 8/2013 | Suzuki | G03G 15/167 | 399/304 |
| 2017/0152120 | A1 | 6/2017 | Montoya et al. | | |

FOREIGN PATENT DOCUMENTS

| | | | |
|---|---|---|---|
| EP | 0260882 | A2 | 3/1988 |
| EP | 0949174 | A1 | 3/1999 |
| TW | M544508 | U | 7/2017 |

OTHER PUBLICATIONS

International Preliminary Report on Patentability in PCT No. PCT/US2016/064372, dated Jun. 14, 2018, 9 pages.

* cited by examiner

ROLLED MATERIAL TENSIONING AND LOADING SYSTEM

CROSS-REFERENCE TO RELATED APPLICATIONS

This application entitled "Rolled Material Tensioning And Loading System" claims the benefit of U.S. Provisional Application No. 62/261,699, entitled "Rolled Material Tensioning And Loading System," and filed Dec. 1, 2015. The entirety of the aforementioned application is incorporated by reference herein.

TECHNICAL FIELD

Aspects provide methods and systems for feeding a rolled material to a processing station with the material tensioned by an unsupported portion of the material.

BACKGROUND

Manufacturing systems that process rolled materials, such as textiles, convey the material through the system. Tension may be applied by pulling the material in a first direction and resisting the pulling force by a resisted unrolling of the material. However, depending on the size of the roll at different phases of the manufacturing process, the resistance provided to generate tension on the material may change as the mass of the material about the roll changes. Additionally, in batch processes, the material may be cut into discrete lengths and then tensioned in a frame or other maintaining device.

BRIEF SUMMARY

Aspects hereof provide systems and methods for tensioning a material in a manufacturing process. The method includes positioning, with a tensioning device, a roll of material above a processing station in a first position and unrolling the material until the material engages with the processing station. The roll is then positioned longitudinally spaced from the processing station in a second position wherein the material is unrolled to form a material sag portion between the roll and the processing station. The material sag portion uses the mass of the material that is self-supporting between the tensioning device and the process station to resist being fed through the process station. This resistance results in a tension force being applied to the material as it passes through the processes station. The amount of tension can be maintained by detecting an amount of material forming the sag portion and adjusting a rotational velocity of the roll to maintain the amount of material forming the sag portion within a range for the material as the material feeds through the processing station. By maintaining an amount of material in the sag portion a relatively consistent resistance and resulting tension is self-supplied by the material as it is fed through the process station.

This summary is provided to enlighten and not limit the scope of methods and systems provided hereafter in complete detail.

DESCRIPTION OF THE DRAWINGS

The present invention is described in detail herein with reference to the attached drawing figures, wherein.

DETAILED DESCRIPTION

Figure 1:
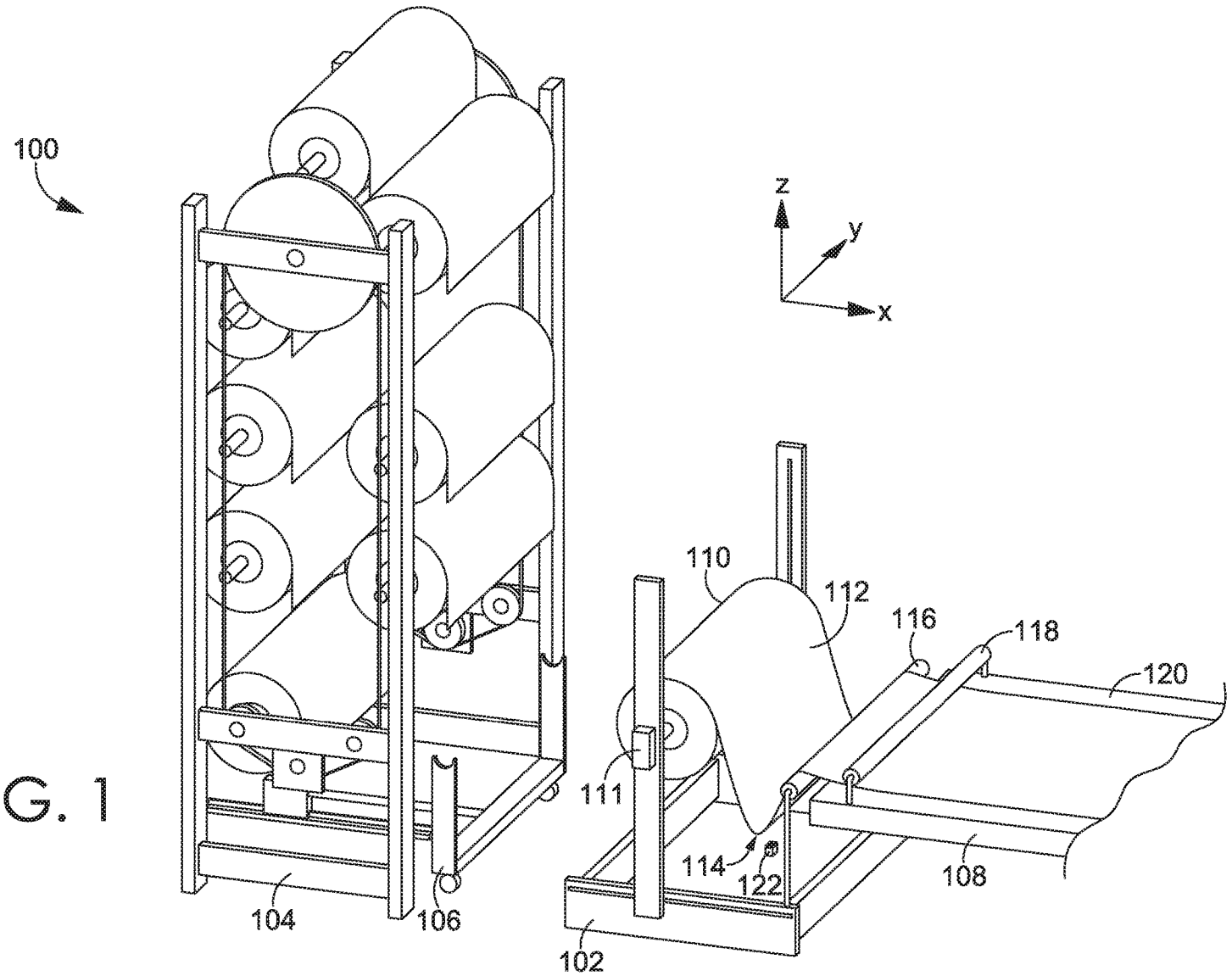
FIG. 1 depicts a material tensioning system that is used in a manufacturing process, in accordance with aspects hereof.

Flexible materials, such as textiles, leather, films, and the like, may be stored and transported in a rolled configuration. The flexible material may be fed into one or more processing station to manufacture an article, such as clothing, footwear, outerwear, and the like. During the processing (e.g., cutting, painting, adhering, stitching, texturizing, punching) by the processing station, the material is maintained taut to prevent processing errors. For example, if the material bunches, shifts, or skews, as it is being processed, the resulting product may not conform to standards. To prevent this unintentional presentation of the material to the process station, the material may be kept under a defined amount of tension as the material advances through the process station.

Maintaining an appropriate amount of tension on the material can be challenging with a rolled good. For example, if a resistive element, such as a friction brake, resists an unrolling of a material roll, as the diameter of the material roll changes with use of the material, the amount of tension experienced by the material in the processing station may also change with a constant resistive force. For example, as the roll diameter decreases, the amount of force applied to the material to maintain a constant feed rate may increase causing an increased tension. If the material has stretch characteristics, the tension applied to the material may cause the material to exceed an amount of deformation for the process operation to be performed. For example, if the material is elongated because of the tension applied and the material is cut into discrete elements while under tension, the resulting discrete elements may not be an intended dimension or size.

Further, consistent tension may be maintained by dividing material from a roll into discrete portions that may be maintained in tension by frames that pass through the processing stations. This results in a batch processing of the material and introduces edges as the continuous material is cut into discrete portions capable of being maintained by a frame. The batch processing and introduction of edges may insert processing inefficiencies into the system.

Aspects hereof provide systems and methods for tensioning a material in a manufacturing process. The method includes positioning, with a tensioning device, a roll of material above a processing station in a first position and unrolling the material until the material engages with the processing station. The roll is then positioned longitudinally spaced from the processing station in a second position wherein the material is unrolled to form a material sag portion between the roll and the processing station. The material sag portion uses the mass of the material that is self-supporting between the tensioning device and the process station to resist being fed through the process station. This resistance results in a tension force being applied to the material as it passes through the processes station. The amount of tension can be maintained by detecting an amount of material forming the sag portion and adjusting a rotational velocity of the roll to maintain the amount of material forming the sag portion within a range for the material as the material feeds through the processing station. By maintain an amount of material in the sag portion a relatively consistent resistance and resulting tension is self-supplied by the material as it is fed through the process station.

Aspects may be accomplished with a material tensioning system that is used in a manufacturing process. The system may include a tensioning device, a shuttle, and a material, storage retrieval ("MSR") system, and a processing station, in an exemplary aspect. The tensioning device may include a longitudinal position movement mechanism, such as a pneumatic drive, a hydraulic drive, a linear actuator, a stepper motor, or the like. The longitudinal position movement mechanism adjusts a position of a roll of the material between a first position and a second position in a longitudinal direction of the system that corresponds with a material flow direction. A material flow direction is a direction in which the material extends through the system. The tensioning device also includes a material sag sensor, such as a caliper, a laser measuring device, an optical detector, a vision system, and the like. The material sag senor is able to determine a nadir distance of the material as it extends between the roll and a processing station in the longitudinal direction. The nadir distance is a measurement of the nadir, a low point of the material as it sags between the roll and the process station. The tensioning device also includes a roll rotator, such as a stepper motor, a rotational actuator, a pneumatic motor, a hydraulic motor, and the like. The roll rotator rotates the roll about an axis that is perpendicular to the material flow direction. A rotational velocity of the roll rotator is adjusted based on information from the material sag sensor to maintain a nadir distance range for the material extending between the roll and the processing station.

Additional aspects contemplate systems and methods for determining an apron of material is present on the roll, for forming an apron on the roll, and for transferring the apron of the material to the process station to initiate the feeding of the material through the process station. As used herein, an apron is a portion of the material extending away from the roll, such as a tangential extension of the material. As the material may have a memory for shape and/or an adhesive attraction to an underlying layer of rolled material, some materials remain wound about a roll even when the roll is rotated in a direction to cause an unrolling of the material thereof. However, when an apron is present or formed, the material may be more easily unrolled from the roll in an automated and consistent manner.

As such, aspects provided herein contemplate automating the retrieval, loading, tensioning, feeding, and processing of a rolled material in a manufacturing system. This automated approach may allow for a single production line to process a variety of materials and components with minimal intervention. For example, a roll of material may be exchanged for another roll of material midway through using the material on the initial roll. The transferring of rolls allows for a variety of materials to be used in varied amounts without dedicated human intervention to cause the transition between materials, which may save human resources and increase efficiencies.

Turning to FIG. 1 that depicts a material tensioning system 100 that is used in a manufacturing process, in accordance with aspects hereof. The system 100 is comprised of a tensioning device 102, a MSR system 104, a shuttle 106, and a process station 108. It is understood that additional or fewer components/devices/systems may be used in any combination. Further, it is contemplated that any number of any of the components may be combined to achieve a system as provided herein. Further yet, it is contemplated that one or more of the elements provided herein may be omitted or configured differently, in aspects.

The MSR system 104 is comprised of a frame structure configured to maintain one or more material rolls. As depicted in FIG. 1, the MSR system maintains a plurality of material rolls that may be selectively positioned on a conveyance mechanism for retrieval by the shuttle 106, as will be discussed hereinafter. The MSR system 104 may also be comprised of one or more sensors. The sensors are effective to identify roll inventory maintained thereon. For example, the sensor may be a radio frequency identification ("RFID") technology effective to determine an identification of a material roll having an RFID tag or other identifier associated therewith. As such, the conveyance mechanisms may position a material roll requested for being processed and identified through a scanner at a location effective for being transferred to the shuttle 106.

The shuttle 106 is comprised of a longitudinal movement mechanism (i.e., in the X axial direction of FIG. 1) and a vertical movement mechanism (i.e., in the Z axial direction of FIG. 1). The movement mechanisms may leverage hydraulic, pneumatic, or electric power supplies. For example, a pneumatic cylinder and valve assembly may be effective to move the shuttle 106 in the longitudinal direction and to also move portions of the shuttle 106 in the vertical direction. For example, the longitudinal movement mechanism may position support arms of the shuttle 106 in a position to transfer a material roll from the MSR system 104. Once positioned longitudinally, the vertical movement mechanisms may raise transfer arms in a vertical direction to lift a spindle supporting the material roll from the MSR system 104. The longitudinal movement mechanism may then move longitudinally to the tensioning device 102. The vertical movement mechanisms may then move in the vertical direction (e.g., lower) to transfer the spindle holding the material roll to the tensioning device 102. Therefore, it is contemplated that the shuttle 106 may transfer material rolls between the MSR system 104 and the tensioning device 102 in a coordinated and potentially automated manner. In an exemplary aspect, the shuttle 106 is anchored to a base structure (e.g., floor) and the longitudinal movement mechanism applies force (e.g., compression or tension) to the anchor causing an opposite end to move.

The tensioning device 102 is effective to maintain a level of tension as the material extends through the process station 108. For example, a roll 110 having material 112 thereon extends across a longitudinal space, the material 112 forms a sag portion having a nadir 114 before returning up to a roller 116. The material 112 passes over the roller 116 and is fed through the process station 108 on a conveyance mechanism 120. As the material 112 is fed at various rates through the process station 108, a roll rotator 111 of the tensioning device rotates the roll 110 to unroll the material 112. The roll rotator may be a rotational mechanism powered by an electric motor, pneumatic power, or hydraulic power. For example, the roll rotator may be an electric motor mechanically engaged with a spindle of the roll 110 to cause a rotational motion of the roll in an axis (e.g., Y axis of FIG. 1) perpendicular to the longitudinal direction. As the diameter of the roll 110 changes through use of the material 112 wound thereon, a rotational velocity of the roll rotator 111 may change to achieve a consistent amount of sag portion of the material. It is contemplated that this amount of sag portion may be determined through the measuring of the nadir by a sensor, such as a sag sensor 122.

The sag sensor 122 measures the nadir 114 position. The sag sensor 122 may use a laser to gauge a distance between the nadir 114 and another point, such as the sag sensor itself. The sag sensor 122 may alternatively or additionally be a vision system, an optical sensor, or other device and technology to determine a position of the nadir 114. In an exemplary aspect, the tensioning device 102 includes additional position sensors so that a distance between the roll 110 and the roller 116 may be determined and combined with the nadir 114 position from the sag sensor, an amount of material 112 forming the sag portion between the roll 110 and the roller 116 may be calculated. As will be provided hereinafter, a computing device may include a known density or other measure for a material to control an amount of sag portion to achieve a range of resulting tension to material extending through the process station 108. Therefore, the system 100 is effective to adjust a tension experienced by a material passing through a process station by manipulating an amount of material that is unsupported and therefore sagging. This unsupported material provides an effective amount of tension for controlling quality during a process step without overly tensioning the material 112. The material sag portion may be calculated as extending between the roll 110 and another supporting structure, such as the roller 116.

The tensioning device may be comprised of additional sensors, such as positional sensors. The positional sensors may be effective to determine a lateral, longitudinal, and vertical position of the roll 110 as maintained by the tensioning device. With this positional data and information from the sag sensor 122, a computing device can calculate an amount of material forming a sag portion and therefore an amount of tension formed by the sag portion. Further, it is contemplated that the computing device, as provided above, may also maintain information related to the density and/or weight of the material held by the tensioning device 102 so as to adjust a sag portion for a given material. Further, it is contemplated that the computing device maintains one or more recipes or instructions that prescribe an amount of tension and therefore sag portion a given material should have for a given operation to be performed on the material. Additionally, it is contemplated that a tension sensor is provided that measures an amount of tension experienced by a portion of the material and adjusts the sag portion to adjust the detected tension.

The sag sensor 122 may be of a number of sensor types. For example, it is contemplated that the sag sensor is a laser-based sensor for determine a distance from the nadir 114 to one or more points, such as the sag sensor 122 itself. In another aspect, it is contemplated that the sag sensor 122 is vision system the is effective to capture an image of the material 112 in the sag portion to calculate the nadir 114 and/or an amount of material 112 forming the sag portion. Additionally, it is contemplated that the sag sensor is a mechanical sensor, such as a caliper, that is effective to determine distance to the nadir 114. In general, the sag sensor is a sensor that is able to capture information useable for determining an amount of material forming the sag portion, which may be calculated based on the nadir 114 and additional information and/or calculated based on a measure of material itself (e.g., length of material forming the sag portion). Further, while the sag sensor 122 is depicted below the material 112 proximate the nadir 114 in the longitudinal direction, the sag sensor 122 may be positioned at alternative locations. For example, the sag sensor 122 may be positioned to capture a profile side perspective (e.g., FIG. 2 hereafter), on the process station 108, and/or elsewhere in relation to the tensioning device 102.

The tensioning device 102 is further comprised of movement mechanisms. Movement mechanism may be of any type. In an exemplary aspect, a movement mechanism is a pneumatic actuator, a hydraulic actuator, an electric linear actuator, a stepper motor, and/or the like. Therefore, it is contemplated that the movement mechanisms may leverage a variety and alternative technologies to cause a movement of one or more components. The movement mechanisms of the tensioning device 102 include a longitudinal movement mechanism 126, as will be discussed hereinafter in FIG. 5, that allows for movement of the roll 110 in the material flow direction (i.e., X axis). The tensioning device may also be comprised of a vertical movement mechanism 128, as will be discussed hereinafter with FIG. 7, which allows for movement of the roll 110 in the vertical direction (i.e., Z axis). And it is contemplated that the tensioning device 102 is comprised of a lateral movement mechanism that is effective to move the roll 110 in a lateral direction (i.e., Y axis). For example, the lateral movement mechanism may adjust an alignment of the material 112 as it is fed through the process station 108 and as detected by one or more sensors (e.g., edge detection sensors associated with the process station 108). It is contemplated that the various movement mechanisms of the tensioning device may act independently or in concert with each other to position the material 112 of the roll 110 in one or more positions to achieve aspects provided herein. Further, it is contemplated that the positional sensors contemplated herein and the movement mechanisms of the tensioning device 102 may be in communication with a computing device to achieve aspects contemplated herein.

The process station 108 is a device for performing a process on the material 112. The process station 108 performs processes contemplated in association with the manufacture of an article formed with the material 112, such as article of footwear and articles of apparel. Additional article types are contemplated, such as automotive, medical, aerospace, marine, electronics, and the like. For example, the process station 108 may be effective to cut, sew, adhere, texturize, stamp, punch, paint, treat, cure, dry, and the like. In a specific example, the process station 108 is a laser cutting device having a laser for cutting the material 112. In another example, the process station 108 is comprised of a nozzle that is effective to apply a surface treatment, such as a dye, adhesive, paint, coating, and the like to the surface of the material 112. Further, it is contemplated that the process station is comprised of a punch or die that are effective to compress the material 112 to form a stamp, hole, cut, texture, embossment, and the like. As can be appreciated, the process station 108 may be comprised of a variety of tools and components to process the material 112. It is also appreciated that not all components/tools may be present at a common device and some may be omitted altogether.

The conveyance mechanism 120 is a component for conveying the material 112 to and/or through the process station 108. For example, it is contemplated that the conveyance mechanism 120 is a conveyor-like mechanisms that has a belt-like element that is effective to feed the material 112 through the process station 108. Further, it is contemplated that the conveyance mechanism 120 is a vacuum surface that forms a low air pressure region proximate therewith that maintains the material 112 in connection with the conveyance mechanisms 120 as the material 112 is fed through the process station. The vacuum surface may be a conveyor belt or a sliding table. Alternative configurations are also contemplated. As will be provided herein, the conveyance mechanism 120 may serve as an engagement location between the material 112 as provided by the tensioning device 102 and the process station 108.

In an exemplary aspect, it is contemplate that a vacuum surface of the conveyance mechanism 120 is effective to attract and cause an engagement between the material 112 and the conveyance mechanism. For example, as the material 112 may have a shape memory, rigidity, and/or adhesion (e.g., electrostatic) to itself or other elements, the use of vacuum and other techniques may facilitate the automated loading of material from the tensioning device 102 to the process station 108. Other examples include removably coupling a magnetic element to the material, such as at a leading edge of an apron, such that the magnetic element is attracted to a magnetic or ferrous element associated with the conveyance mechanism 120. Therefore, as the material having the magnetic element is brought into proximity with the conveyance mechanism 120 (or the process station 108 generally), a magnetic attraction may assist in the engagement (e.g. positioning, alignment, interaction) of the material and the process station 108. Additionally, it is contemplated that a weighted element that leverages an increase in mass may be removably coupled with the material to overcome the forces of the material that may resist or hinder engagement with the process station 108 from the tensioning device 102.

As previously provided, the system 100 is comprised of a variety of devices/components/elements; however, it is contemplated that additional features may be provided and/or some of the features may be omitted altogether while maintaining aspects contemplated herein.

Figure 2:
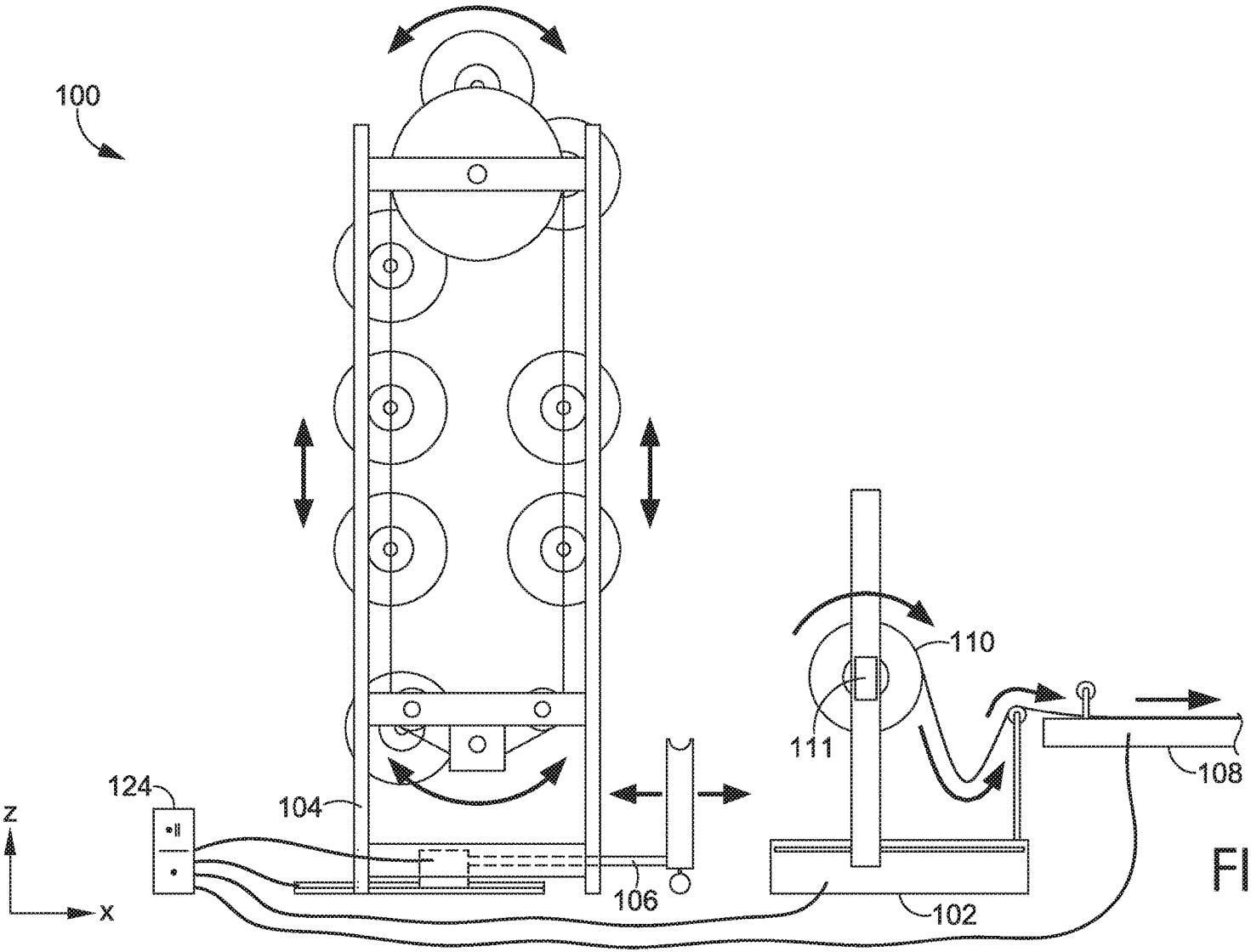
FIG. 2 depicts a side projection view of the system of FIG. 1, in accordance with aspects hereof.

FIG. 2 depicts a side projection view of the system 100 of FIG. 1, in accordance with aspects hereof. The system is comprised of the tensioning device 102, the process station 108, the MSR system 104, and the shuttle 106. Additionally depicted in this view is an exemplary computing device 124 logically coupled with the tensioning device 102, the MSR system 104, the shuttle 106, and the process station 108. However, it is contemplated that the computing device 124 may be logically coupled to different combinations of components or not coupled with one or more of the components. The computing device 124 is effective to communicate information and receive information effective to facilitate the processing of material with the system 100. For example, the computing device 124 may receive information from positional sensors that are then used to cause a movement mechanism to adjust a position of the material to achieve a defined tension or other operation of the material in the system 100. The computing device 124 is also effective to coordinate the operation of the various elements of the system 100. As such, the computing device may control one or more movements, positions, activations, and the like of the various elements of the system 100 to achieve aspects contemplated herein.

The computing device 124 has a processor and memory. The computing device 124 may include a variety of computer-readable media. Computer-readable media can be any available media that can be accessed by computing device 124 and includes both volatile and nonvolatile media, removable and non-removable media. By way of example, and not limitation, computer-readable media may comprise computer storage media and communication media. Computer storage media includes volatile and nonvolatile, removable and non-removable media implemented in any method or technology for storage of information such as computer-readable instructions, data structures, program modules, or other data.

Computer storage media includes non-transitory RAM, ROM, EEPROM, flash memory or other memory technology, CD-ROM, digital versatile disks (DVD) or other optical disk storage, magnetic cassettes, magnetic tape, magnetic disk storage, or other magnetic storage devices. Computer storage media does not comprise a propagated data signal.

Communication media typically embodies computer-readable instructions, data structures, program modules, or other data in a modulated data signal such as a carrier wave or other transport mechanism and includes any information delivery media. The term "modulated data signal" means a signal that has one or more of its characteristics set or changed in such a manner as to encode information in the signal. By way of example, and not limitation, communication media includes wired media such as a wired network or direct-wired connection, and wireless media such as acoustic, RF, infrared, and other wireless media. Combinations of any of the above should also be included within the scope of computer-readable media.

The computing device 124 may include computer-readable media having instruction embodied thereon that are effective to cause one or more elements of the system 100 to perform one or more actions. For example, the instructions may cause a movement mechanism to move, a laser to emit laser energy, a camera to capture an image, a register to register a position of the material, and a processes station to perform an operation, in an exemplary aspect.

FIG. 2 also depicts the movement of various elements and the material with illustrative arrows. For example, the MSR system 104 is depicted has being functional to rotate through a plurality of material rolls. Therefore, if a particular material roll is requested to be transferred to the tensioning device 102, the MSR system 104 may cycle through the rolls until an appropriate roll is presented at a location at which the shuttle 106 can transfer and convey the roll. For example, the shuttle 106 is depicted as moving in the longitudinal direction that is effective to transfer the roll between the MSR system 104 and the tensioning device 102. However, as provided above, the shuttle may also move in a vertical direction (e.g., vertical extending arms to capture and deposit the roll). The roll 110 is depicted as rotating at the tensioning device 102 as caused by the roll rotator 111. As the material extends from the roll 110 towards the process station 108, a sag portion is formed where the rotating resistance of the roll 110 is isolated from the material entering the process station 108 such that a controlled and consistent tension may be supplied to the material regardless of the roll 110 roll resistance, mass, diameter, and the like.

Figure 3:
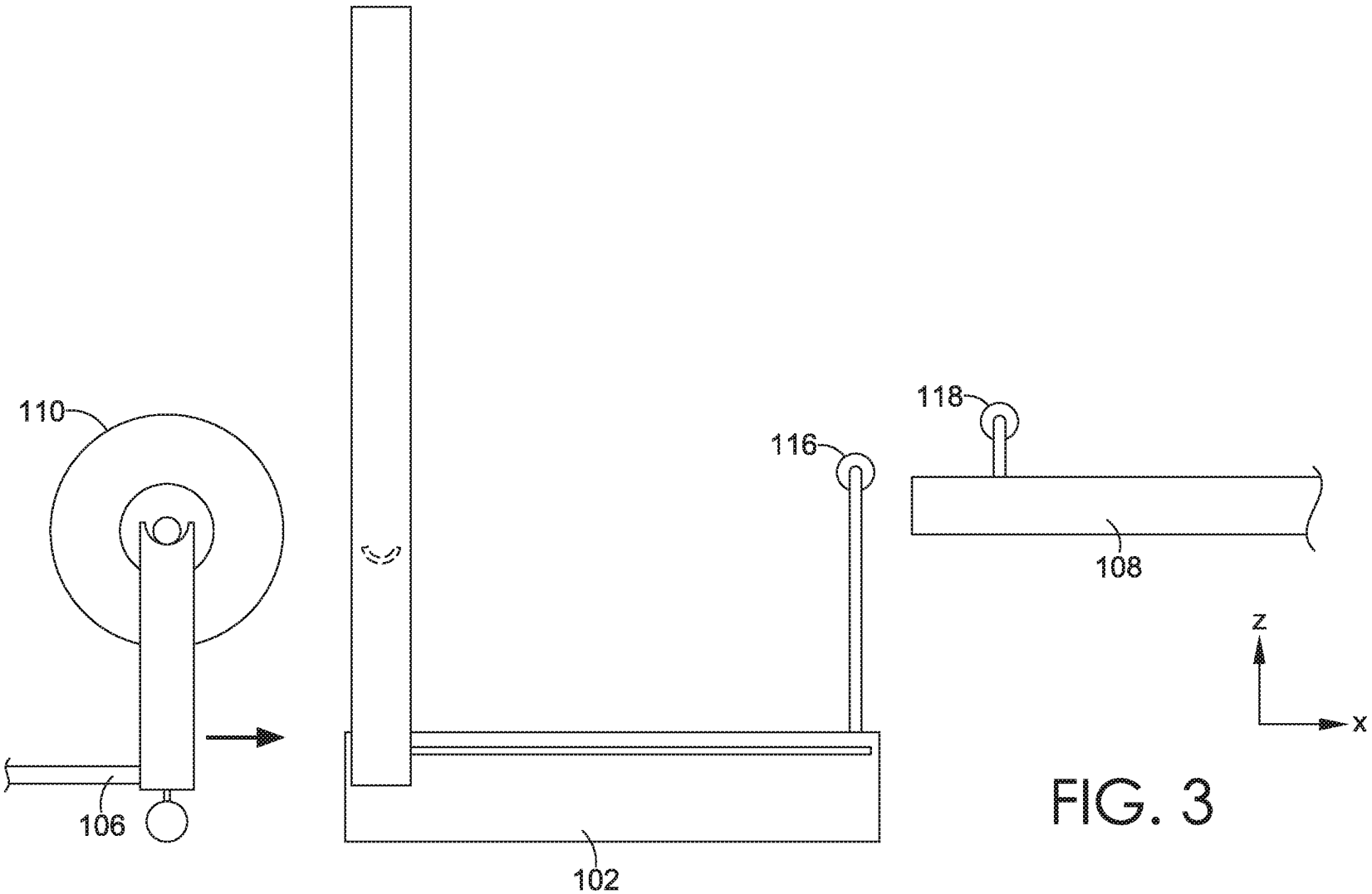
FIG. 3 depicts the roll moving in the longitudinal direction on a shuttle, in accordance with aspects hereof.
Figure 4:
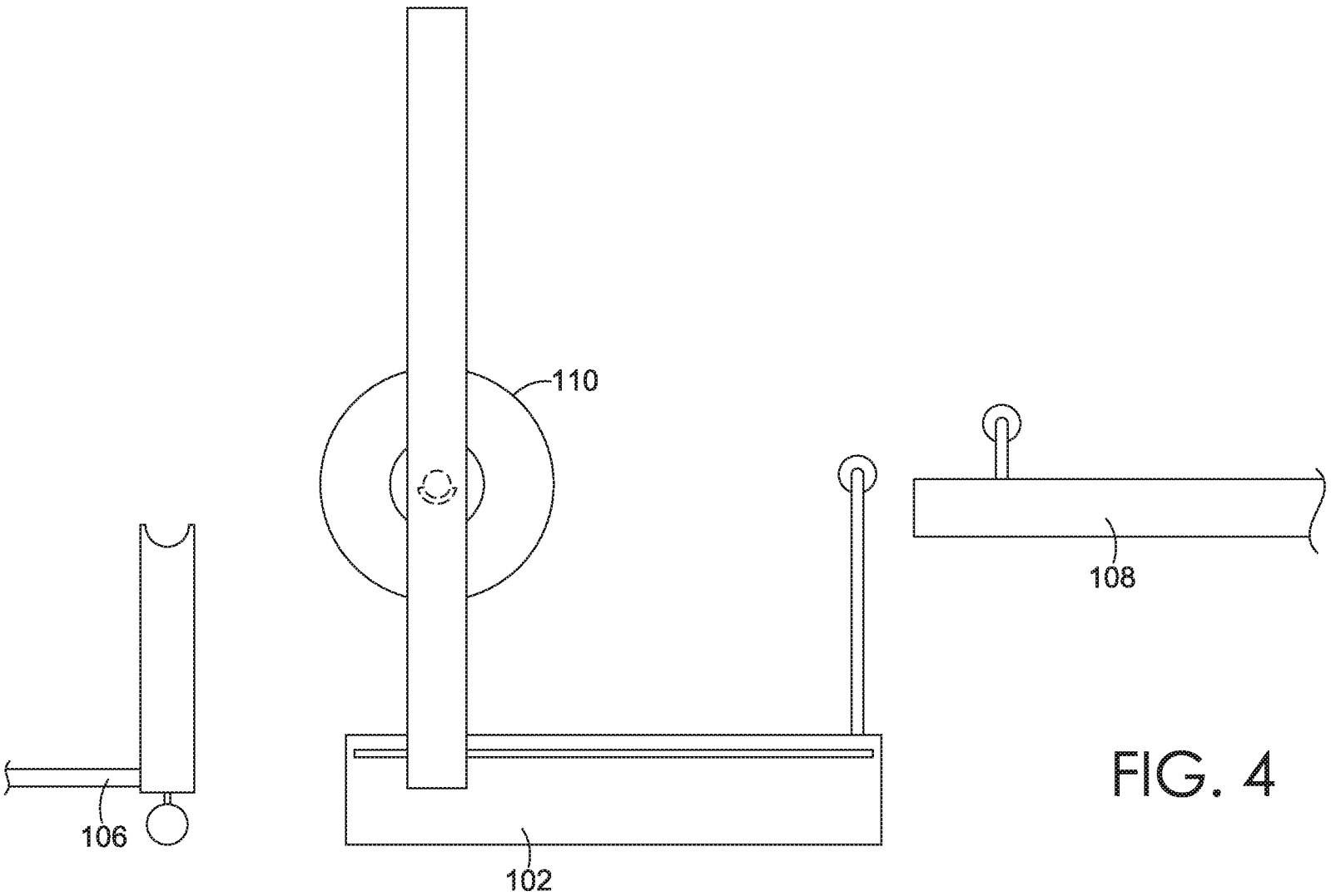
FIG. 4 depicts the roll maintained by a tensioning device, in accordance with aspects hereof.
Figure 5:
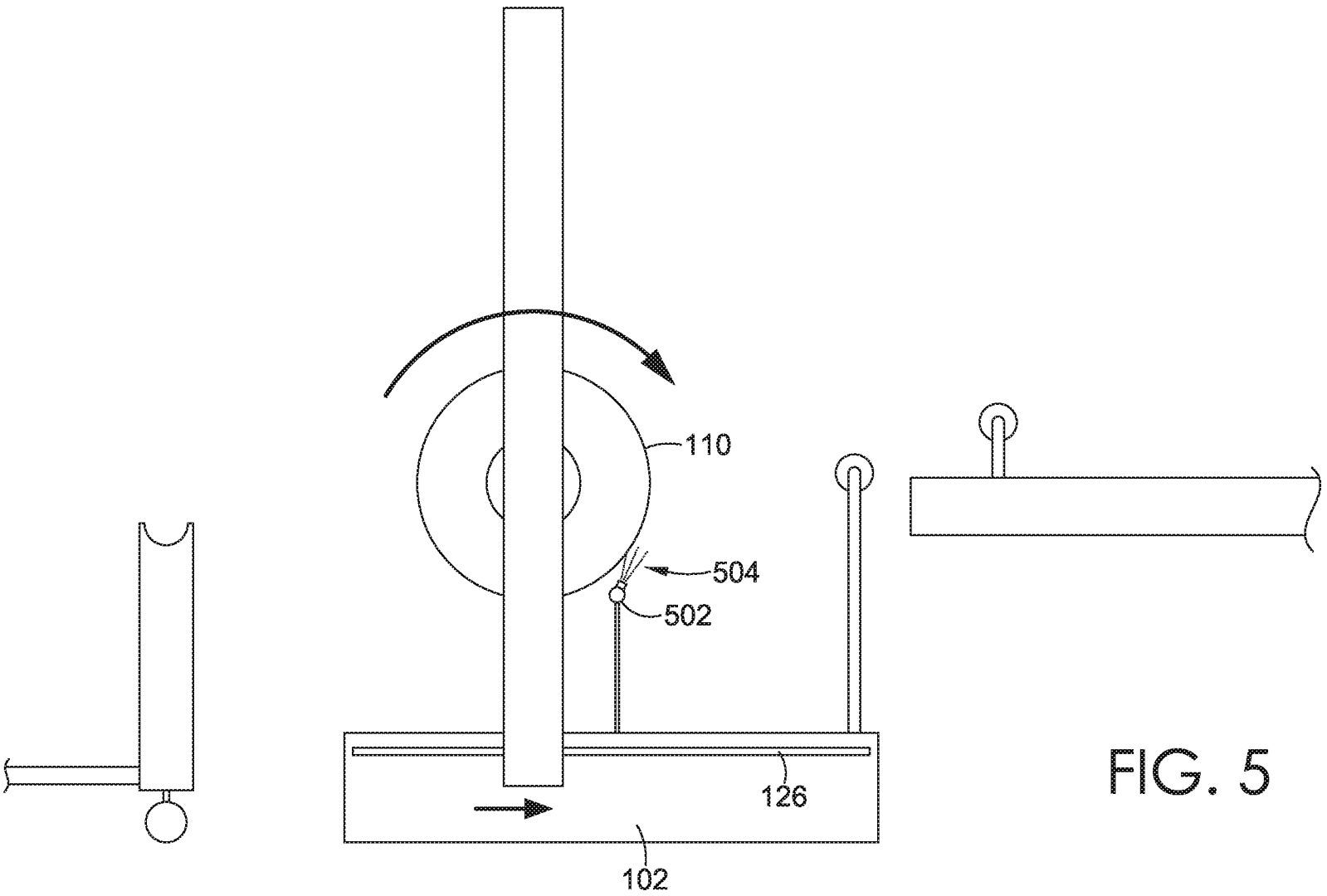
FIG. 5 depicts the roll longitudinally moved by a longitudinal movement mechanism of the tensioning device, in accordance with aspects hereof.
Figure 6:
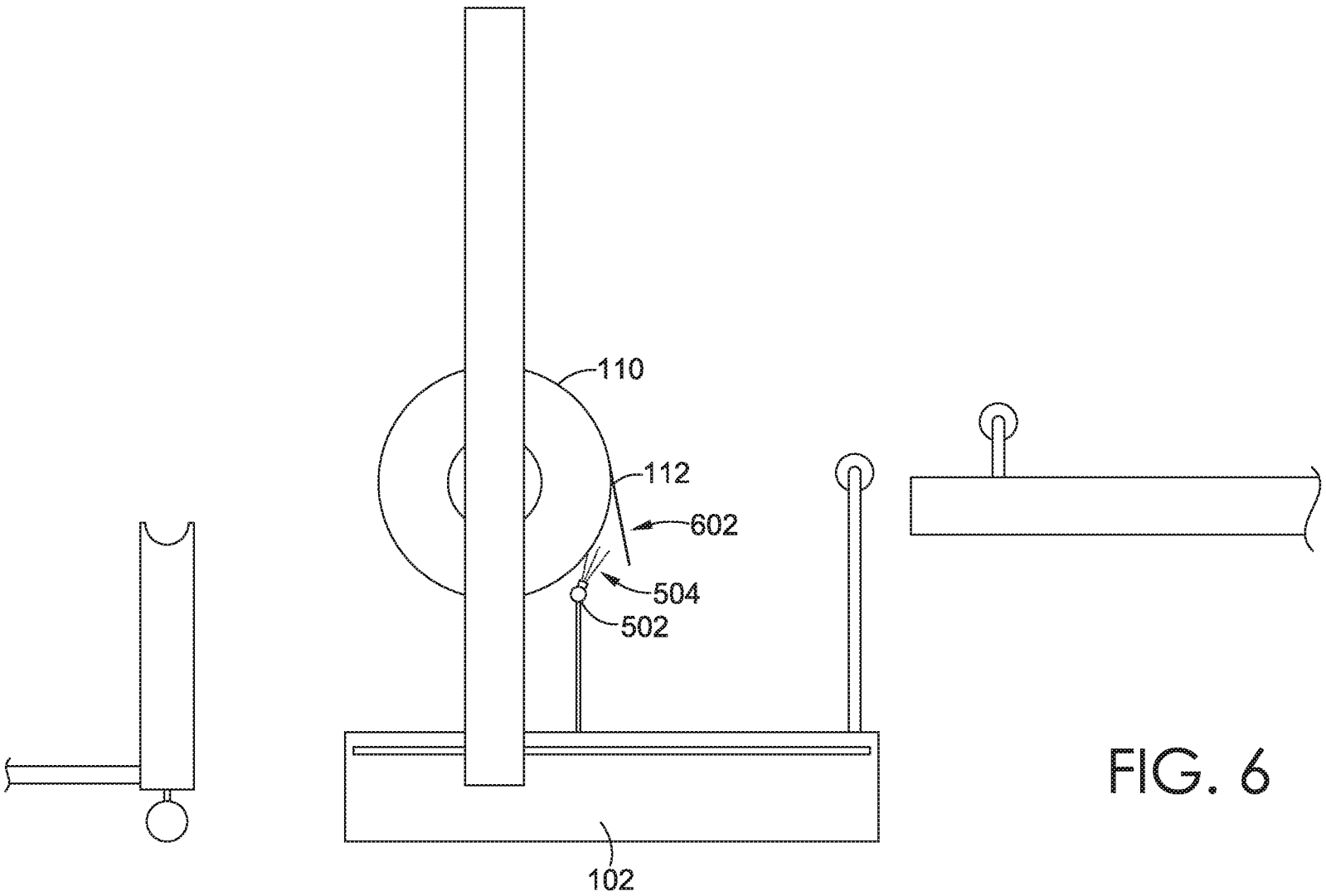
FIG. 6 depicts an apron being formed, in accordance with aspects hereof.

FIGS. 3-10 depict a roll 110 provided to the tensioning device 102 and the rolled material thereon engaged with the process station with a sag portion providing controlled material tension, in accordance with aspects hereof. Some of the figures represent optional steps in the process and may be omitted. For example, FIGS. 5 and 6 depict the detection and formation of an apron from the roll 110, which may be omitted if an apron is previously formed or detected, as will be discussed in greater detail hereinafter.

FIG. 3 depicts the roll 110 moving in the longitudinal direction on the shuttle 106, in accordance with aspects hereof. For example, the roll 110 may have been transferred from the MSR system 104 of FIG. 1. FIG. 4 depicts the roll 110 maintained by the tensioning device 102, in accordance with aspects hereof. It is contemplated that the shuttle 106 moves in a longitudinal direction until proximate the tensioning device 102 at which point the shuttle 106 may extend the roll 110 in a vertical direction (e.g., up or down) to transfer the roll 110 from the shuttle 106 to the tensioning device 102. When transferred to the tensioning device, the roll 110 may be mechanically engaged with the roll rotator to facilitate a rotational movement of the roll 110.

FIGS. 5 and 6 depict an optional step of forming an apron for the roll 110, in accordance with aspects hereof. As provided above, an apron is a portion of material from the roll 110 that extends away from the roll 110, such as a tangential extension. However, because of material shape memory, adhesive attractions, and/or material rigidity, an apron may not naturally occur when unrolling a material. Instead, the leading edge of the material may remain in proximity to an underlying portion of the material rolled about the roll 110. In this situation, a rotational movement of the roll 110 does not result in an unrolling of material from the roll 110. Therefore, if the material does not unroll from the roll 110, automated transferring, loading, tensioning, and feeding of the material for processing is hindered. As such, FIGS. 5 and 6 provide for an apron forming processes that may be optionally implemented in aspect hereof/

In FIG. 5, the roll 110 is longitudinally moved by the longitudinal movement mechanism 126 of the tensioning device 102, in accordance with aspects hereof. The longitudinal movement of the roll 110 repositions the roll 110 from allocation of being transferred from the shuttle to a position for forming of an apron. The apron may be formed by application of an air stream to the surface of the material. For example, one or more nozzles may project air at an angle appropriate to separate a leading edge from an underlying layer of material rolled about the roll 110. As the air maintains a separation between the leading edge of the material and the underlying layer, the roll 110 may be rotated to unroll material as the pressurized air is continued to be applied to prevent a re-rolling or adhesion of the formed apron to the underlying material. Pressurized air 504 is provided by an apron nozzle 502. The apron nozzle 502 is positioned and oriented to project the pressurized air 504 at the roll 110 such that the pressurized air is able to lift the leading edge away from the underlying material as the roll 110 is rotated.

FIG. 6 depicts an apron 602 being formed from the material 112 of roll 110, in accordance with aspects hereof. It is contemplated that the tensioning device 102 may be further comprised of an apron sensor. The apron sensor is effective to sense the presence of the apron 602 and to control the application of pressurized air 504 through one or more valves. Therefore, the apron sensor may be utilized to institute the steps of FIGS. 5 and 6 if an apron is not detected. Further, the apron sensor may be utilized to terminate the apron forming process once a sufficient apron 602 is formed. The apron sensor may be a vision system or other optical sensor capable of detecting the presence of an apron, and in some aspects, determining the size of the apron. Additional sensor technologies (e.g., contact switch) are contemplated as serving as apron sensors.

Figure 7:
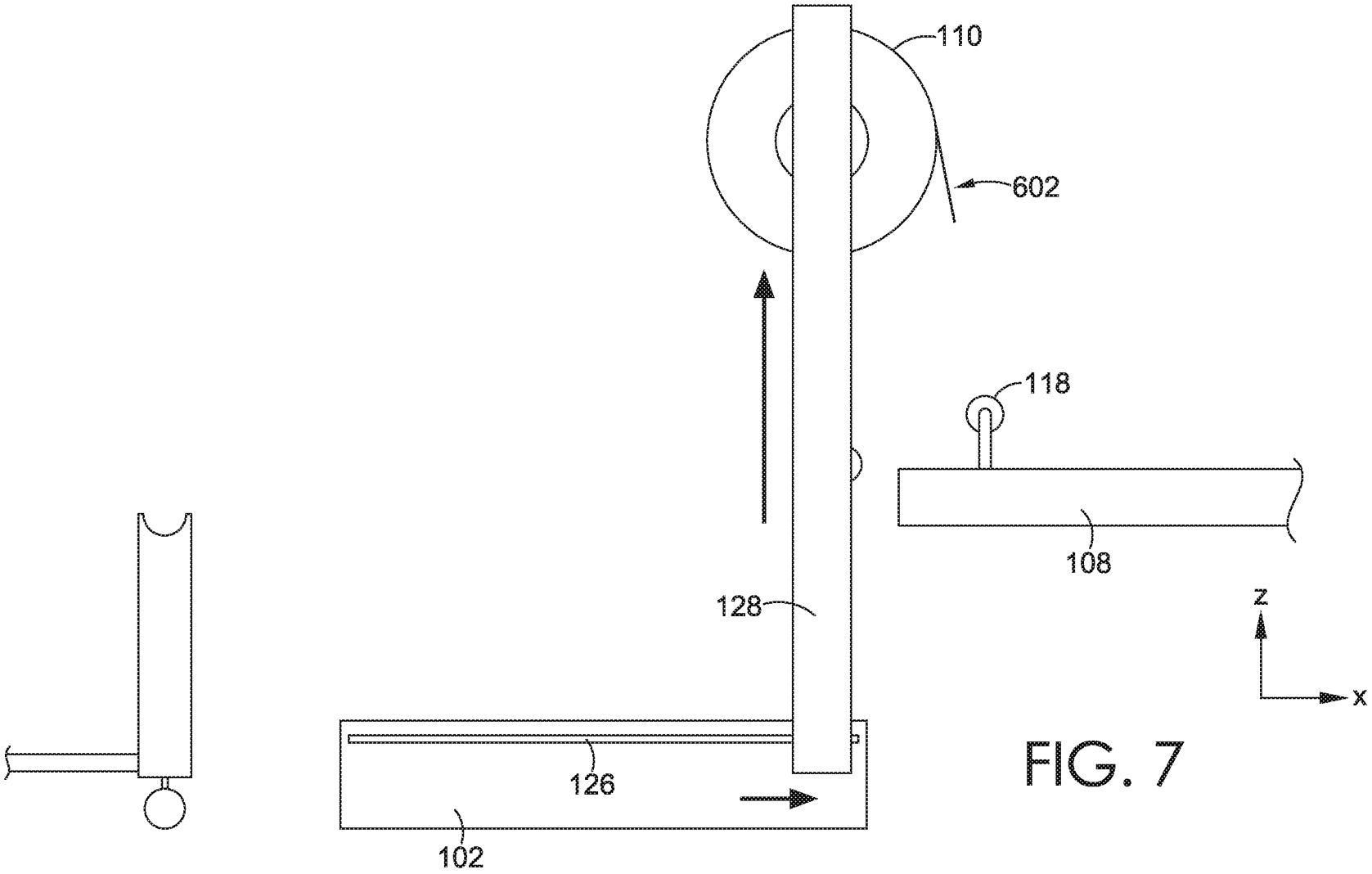
FIG. 7 depicts the tensioning device positioning the roll in a first position through movement by the longitudinal movement mechanism and the vertical movement mechanism, in accordance with aspects hereof.
Figure 8:
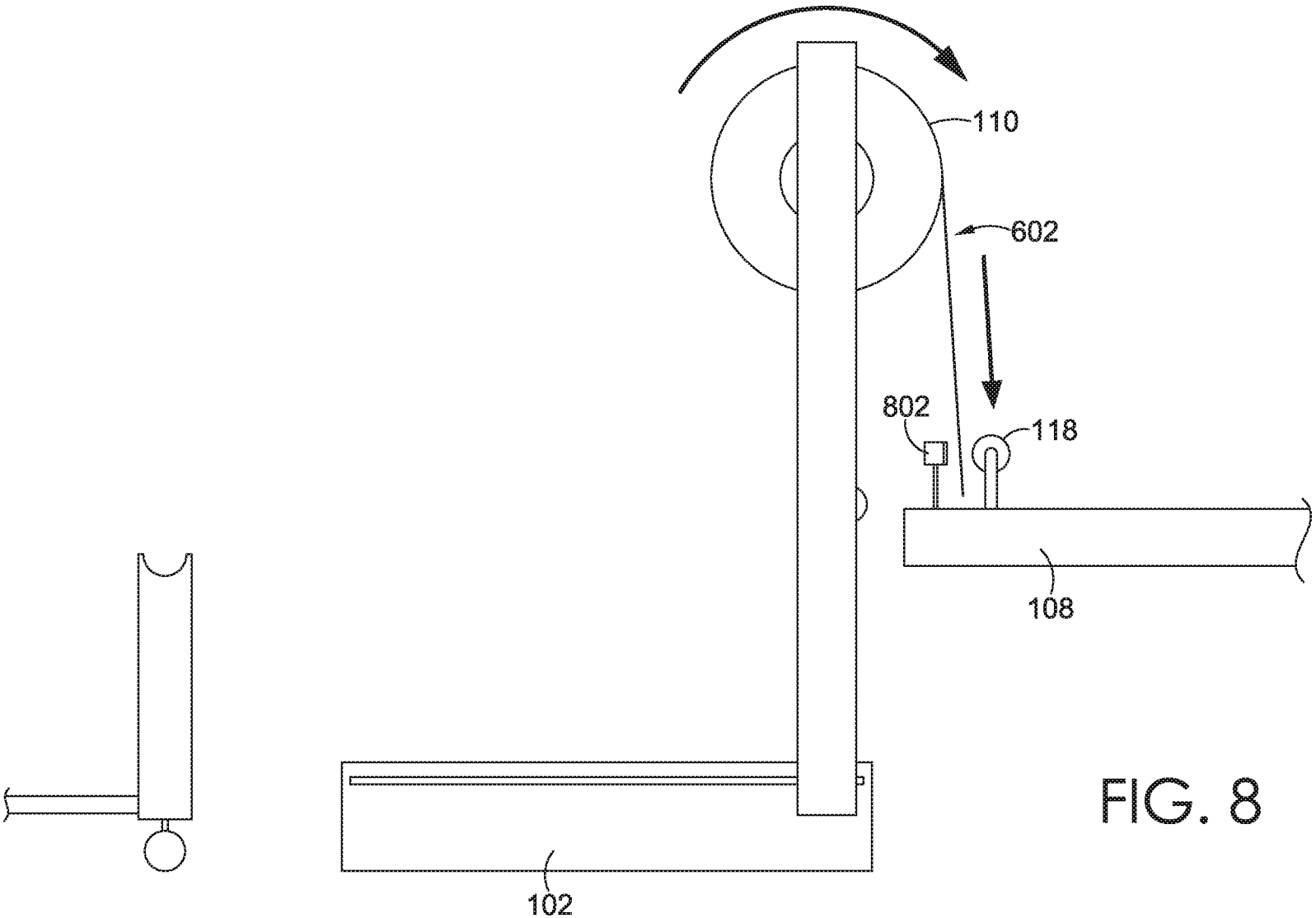
FIG. 8 depicts the apron of the roll extending downwardly towards the process station, in accordance with aspects hereof.

FIG. 7 depicts the tensioning device 102 positioning the roll 110 in a first position through movement by the longitudinal movement mechanism 126 and the vertical movement mechanism 128, in accordance with aspects hereof. The first position of the roll 110 is for illustrative purposes, but it provides a position for the automated engagement of the material on the roll 110 with the process station 108. In this example, the roll 110 is positioned vertically above the process station intended to receive the material, such as a vacuum table. FIG. 8 depicts the apron 602 of the roll 110 extending downwardly towards the process station 108, in accordance with aspects hereof. For example, the roll rotator may be engaged to rotate the roll 110 to allow the material to engage with the process station, as depicted by the illustrative arrows.

Also depicted in FIG. 8 is an engagement sensor 802. The engagement sensor 802 detects the presence of the apron 602 in proximity of the process station 108. The engagement sensor may be optical, visual, and/or mechanical in nature to determine the presence and/or location of the apron 602. In an exemplary aspect, the engagement sensor 802 provides a signal to a computing device that one or more movement mechanisms can cause the movement of one or more components, such as repositioning the roll 110 to a second position, rotating the roll 110 at a particular velocity, initiating the process station 108 conveyance mechanisms, and the like.

Figure 9:
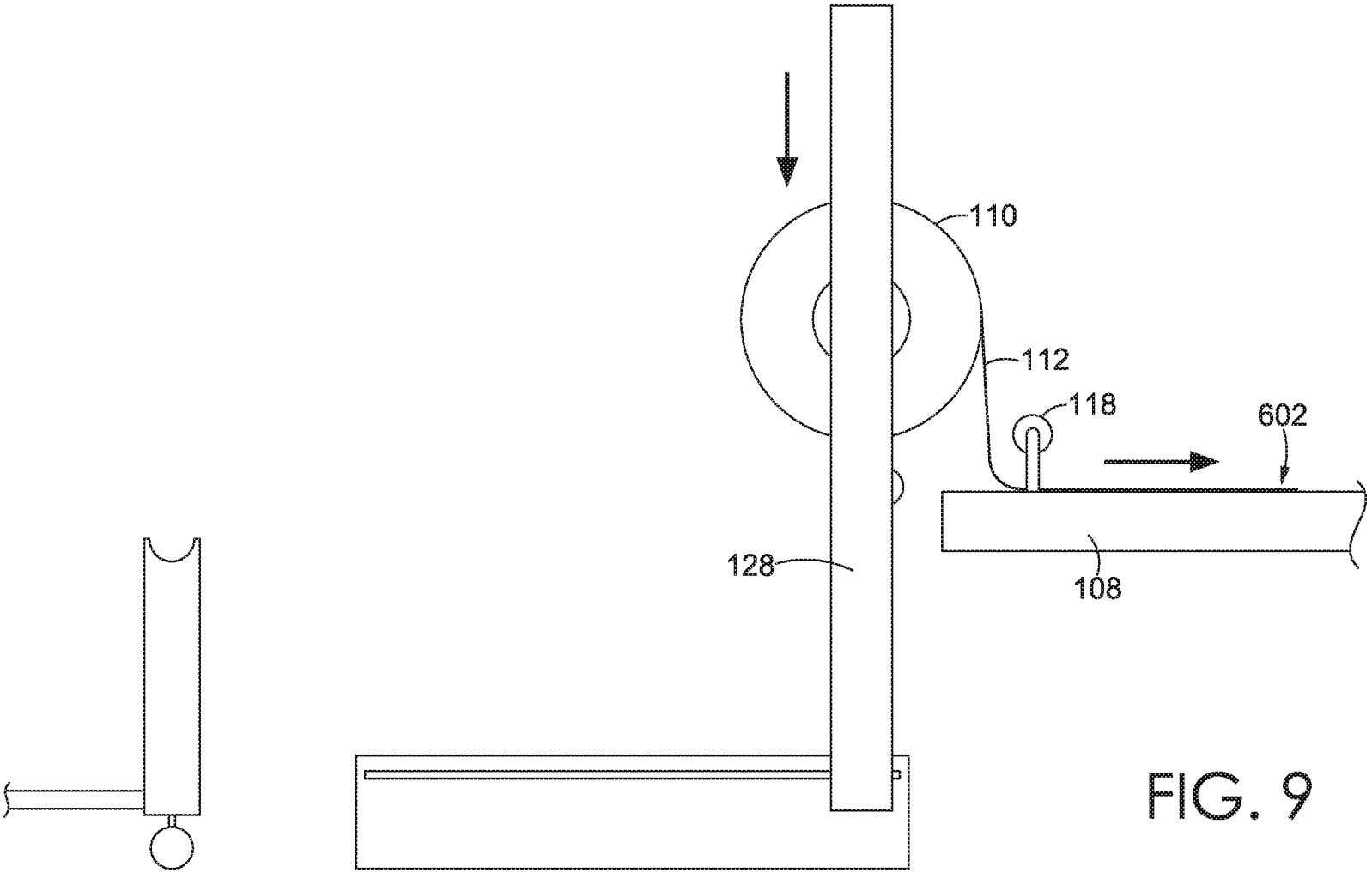
FIG. 9 depicts the material being fed through the process station as the roil is moving to a second position for providing sag tension, in accordance with aspects hereof.

FIG. 9 depicts the material 112 being fed through the process station 108 as the roll 110 is moving to a second position for providing sag tension, in accordance with aspects hereof. A roller 118 is provided to guide the material along the conveyance mechanism of the process station 108. For example, if the conveyance mechanism is a vacuum surface, the roller 118 can ensure adhesion is maintained between the material 112 and the vacuum surface even as the vacuum surface advances in the material flow direction. Without the roller 118, the material 112 may peel up from the vacuum surface as the vacuum surface advances in the material flow direction (e.g., longitudinal direction) as the roller 118 limits an angle between the advancing apron 602 and the roll 110. As also depicted in FIG. 9, the roll is moving in a vertical direction by vertical movement mechanisms 128 in route to the second position. As a sequence of movements, rotation, and other actions are depicted in the series of steps illustrated herein, it is understood that one or more activities may occur simultaneously. For example, a vertical movement and a longitudinal movement occur simultaneously and not in a series. Further, it is contemplated that the roll rotator may rotate the roll during any longitudinal, vertical, and lateral movements by the tensioning system movement mechanisms.

Figure 10:
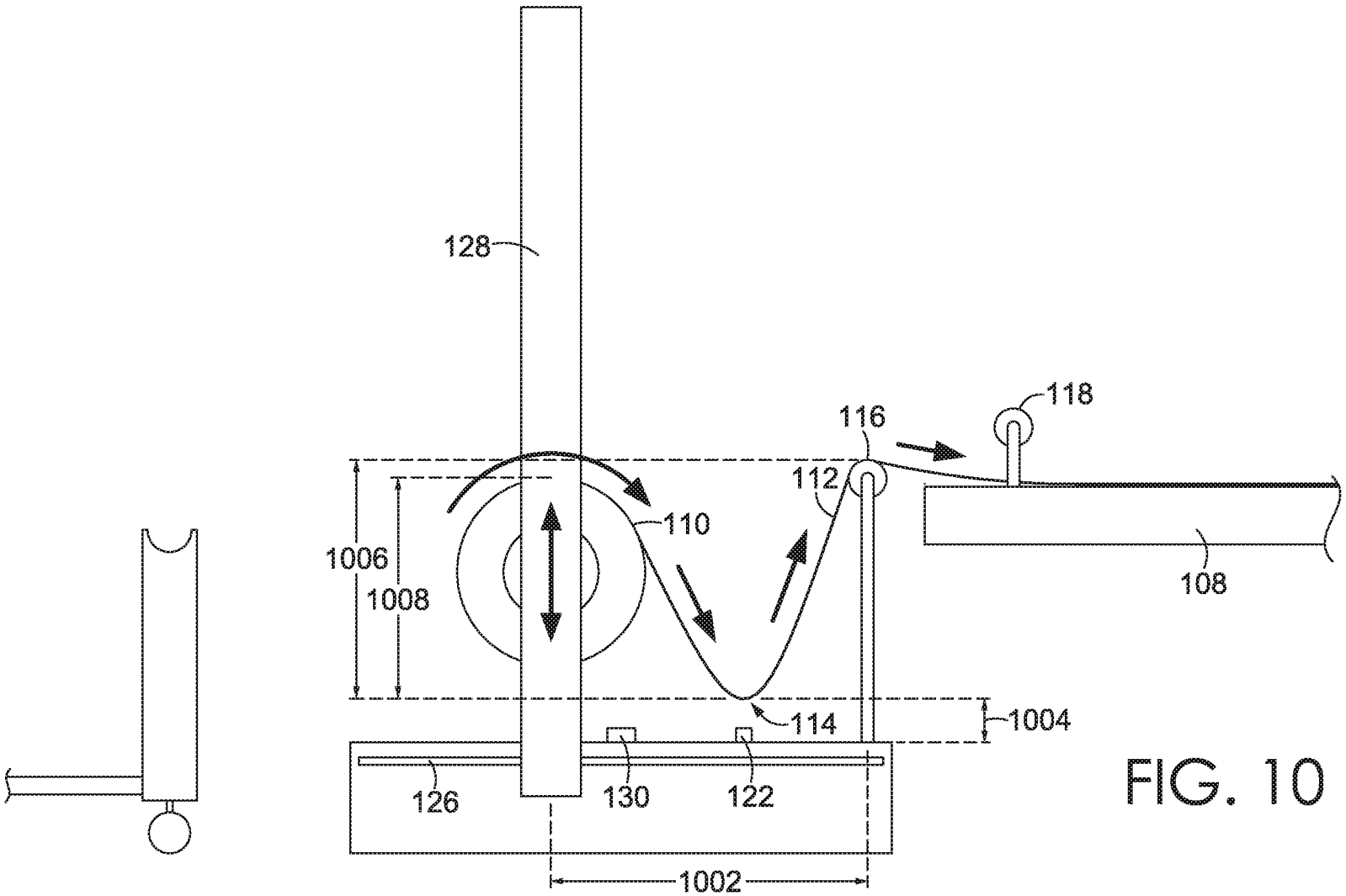
FIG. 10 depicts the roll in the second position having the material forming an unsupported sag portion extending between the roll and the roller, in accordance with aspects hereof.

FIG. 10 depicts the roll 110 in the second position having the material 112 forming an unsupported sag portion extending between the roll 110 and the roller 116, in accordance with aspects hereof. In this example, the roll 110 is positioned by the longitudinal movement mechanism 126 and the vertical movement mechanism 128. The second position may be adjusted based on a number of factors including, but not limited to, the material 112, the size of the roll 110, the process to be performed by the process station 108, inputs from the sag sensor 122, inputs from a roll diameter sensor 130, a rotational velocity of the roll 110, a feed rate by the conveyance mechanism of the process station 108, and the like.

The second position includes the roll 110 being spaced apart in the longitudinal direction a distance 1002. The distance 1002 may be adjusted based on a diameter of the roll 110 to maintain a relatively constant longitudinal distance of the sag portion unsupported as the diameter decreases with unrolling of the material 112. Similarly, a vertical distance may be adjusted as the diameter of the roll 110 changes to maintain a constant sag depth 1008 from the roll 110. The sag depth in this example may be measure from the roll 110 to the nadir 114. Another sag depth may be determined from the roller 116 to the nadir 114 as sag depth 1006. A further measurement that may be captured is a distance 1004 measuring the distance before the nadir 114 interferes with a surface as captured by the sag sensor 122, in this example. The combinations of sag depth 1008, sag depth 1006, and/or distance 1004 may be used to determine a nadir distance, which may be represented as a distance extending above or below the nadir 114 depending on the configuration utilized. In general, however, the nadir distance in combination with other measurements may provide for a total amount (e.g., length, volume) of material 112 forming the sag portion, which in turn can be used to determine an amount of tension applied to the material 112 as it is provided to the process station 108. Therefore, it is contemplated that any combination of distance, such as longitudinal, vertical, and sag may be adjusted to achieve an amount of sag portion and/or material tension.

The diameter sensor 130 is a sensor able to determine a diameter of the roll 110. For example, the diameter sensor 130 may use a laser to determine the diameter. Additionally, it is contemplated that the diameter sensor 130 may use of the sensing technologies, such as vision system, optical, mechanical, and the like. A provided above, the diameter sensor 130 may be used, in part, to adjust a rotational velocity of the roll 110 to maintain a sag portion of the material in a determined range (e.g., length range). Further, the diameter sensor 130 may provide indications as to an amount of material 112 remaining or used from the roll 110. For example, to prevent a shortage of material during a processing operation, the diameter sensor 130 may be used to determine if a suitable quantity of the material is present on the roll 110 to complete the request, in an exemplary aspect.

It is also contemplated that the tensioning device 102 positions the roll in lateral directions based on input from one or more sensors. For example, the conveyance mechanism of the process station 108 may include an edge sensor. The edge sensor detects the edge of the material in relation to the conveyance mechanisms or the process station as a whole. Such that if the material moves out of a tolerance position, the tensioning device 102 adjusts the roll 110 laterally to adjust the edge location, in an exemplary aspect.

As provided herein, based on input from sensors, such as positional sensor, diameter sensors, distance sensors, nadir sensors, and the like, one or more instructions may be provided to movement mechanisms, roll rotator, conveyance mechanisms, and the like to adjust a tension provided by a sag portion of a material.

Figure 11:
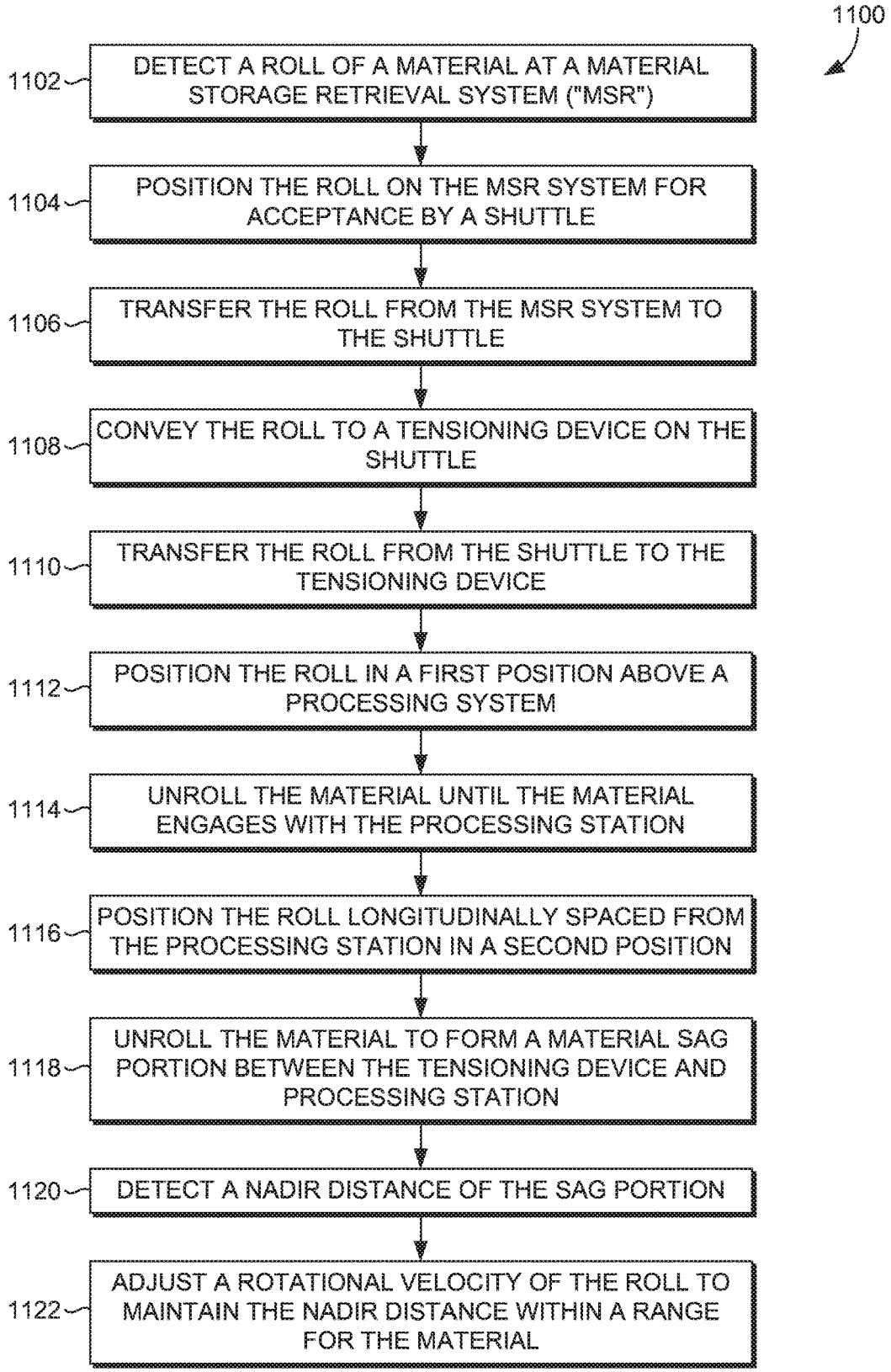
FIG. 11 provides a flow chart depicting a method of tensioning a material in a manufacturing process, in accordance with aspects hereof.

FIG. 11 provides a flow chart 1100 depicting a method of tensioning a material in a manufacturing process, in accordance with aspects hereof. At a block 1102, a step of detecting a roll of a material at an MSR system is provided. The detection of the roll may be accomplished through an RFID sensor to identify a particular roll for use in a processing operation. The detection may be in response to a request from a computing device having a scheduled operation and inventory management of the rolls contained by the MSR system. In response to the determination of the roll of material at the MSR, the MSR positions the roll on the MSR system for acceptance by a shuttle, as depicted in a block 1104. The positioning may include rotating a plurality of rolls until the appropriate roll, such as the detected roll, is in a position at which a shuttle can retrieve the roll. The positioning may be controlled by a local logic unit of the MSR system or from a central computing device coordinating one or more elements.

At a block 1106, the roll is transferred from the MSR system to the shuttle. For example, the shuttle may extend receptor arm structures in an upwardly manner to transfer the weight of the roll from the MSR to the shuttle. The shuttle may then move in a longitudinal direction with the roll maintained on the receptor arms. The shuttle continues transporting the roll to the tensioning device to convey the roll to the tensioning device, as provided in a block 1108.

Once the roll has been conveyed, by the shuttle, from the MSR system to the tensioning device, the roll is transferred to the tensioning device, as provided in a block 1110. The transfer of the roll may include the receptor arms of the shuttle descending in a vertical direction such that the roll engages with the tensioning device and is supported by the tensioning device. The tensioning device may then position the roll in a first position, as provided at a block 1112. The first position is a position for the material of the roll to engage with a processing station. In an exemplary aspect, the first position places the roll above the processing station, such as above or proximate a conveyance mechanism servicing the process station.

The roll is unrolled to allow the material of the roll to engage the processing station, as provided in a block 1114. The unrolling may occur by a roll rotator mechanically engaged with the roll to provide rotational movement of the roll. The unrolling may occur until the material, such as the apron portion of the material, engages the processing station. The engagement, as provided hereinabove, may include bringing the material into proximity with the processing station for the material to be fed there through. For example, the processing station may include a vacuum table or other conveyor mechanism to which the material is attracted. Once the material is brought into proximity with the conveyance mechanism, the attractive forces (e.g., vacuum, magnetic, electrostatic) are sufficient to cause the feeding of the material to and/or through the process station. The sufficiency of the unrolling may be determined, in an exemplary aspect, by one or more sensors.

At a block 1116, the roll is positioned longitudinally spaced from the processing station in a second position. Stated differently, in an aspect, an unsupported distance is provided between the roll of material and the processing station at which the material extends and may form a sag portion of the material. The sag portion may be adjusted to achieve a specified amount of material, which may be measured, in part, with a nadir distance. Additional elements that may be measured to determine an appropriate sag portion include, but are not limited to, positional information on the roll, the sag distance relative to one or more portions, the unroll rate, the roll diameter, and the feed rate into the process station. As such, the material is unrolled to form the sag portion between the tensioning device and the process station, as provided in a block 1118. It is understood that the sag portion may be formed between one or more rollers positioned between or relative to the tensioning device and/or the process station, in accordance with aspects hereof.

At a block 1120 a nadir distance of the sag portion is detected. In an exemplary aspect, the nadir distance is measured with a sag sensor. Further yet, the detecting of the nadir distance is a determination of the sag portion length or amount of the material. As such, the detection of the nadir distance is a determination of the amount of material forming the sag portion, which may be determined by maintaining a known nadir distance. As provided above, the nadir distance may be measured from any point to the nadir, such as from the roll height to the nadir, from the process station to the nadir, from the floor to the nadir, and the like. Further, the position of the roll, the process station, and/or one or more supporting rollers may be used in a determination of the nadir distance and/or the determination of a quantity of material forming the sag portion to establish a tension applied by the material as presented to the process station.

At a block 1122 the rotational velocity of the roll is adjusted to maintain the nadir distance within a range for the material. For example, the roll rotator rotating the roll may adjust a rotational speed of the roll to maintain the sag portion within a defined range, which therefore maintains an applied tension on the material from the sag portion within a defined range. The range may vary for a particular material, for a particular process station, for a particular feed rate, and/or for particular ambient conditions (e.g., temperature, humidity). For example, a computing device may receive inputs from one or more sensors as well as retrieve information stored in memory (e.g., material characteristics, process variables) to determine an appropriate nadir distance to maintain and as a result an appropriate material sag portion for the material. If the nadir distance moves outside of the range (e.g., 1 centimeter to 10 meters, 1 meter to 5 meters, 0.5 meters to 3 meters, 2 meter to 6 meters) for that material, then an insufficient amount of tension is provided by the material sag portion to the material. Further, if the rotation speed is insufficient the material may feed into the process station at a faster rate than the material is unrolled from the material. In this situation, the feeding of the material into the process station will eventual cause the unrolling of the material from the roll (e.g., pulling the material from the roll causing the roll to unroll), which then increases the tension applied to the material to include a force used to unroll the roll, which may vary with roll characteristics and volume. Similarly, if the rotational velocity is greater than the feed rate to the process station for an extended time, the material may collect in the material sag portion region between the tensioning device and the process station, which could damage the material (e.g., dirt, oil, snags) or cause complications with the uptake or down take of the material within the system. As such, maintaining the rotational velocity of the roll within a defined range assists in isolating the forces used to unroll the material from the tensioning of the material and it limits damage to the material, in exemplary aspects.

It is understood that the blocks of FIG. 11 are optional in some aspects. Further, it is contemplated that additional blocks may be inserted. For example, the formation of an apron may be included. Further yet, it is contemplated that one or more steps may be repeated without repeating all of the blocks. Therefore, the blocks of FIG. 11 are exemplary in nature and are not limiting in nature.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

While specific elements and steps are discussed in connection to one another, it is understood that any element and/or steps provided herein is contemplated as being combinable with any other elements and/or steps regardless of explicit provision of the same while still being within the scope provided herein. Since many possible embodiments may be made of the disclosure without departing from the scope thereof, it is to be understood that all matter herein set forth or shown in the accompanying drawings is to be interpreted as illustrative and not in a limiting sense.

The invention claimed is:

1. A material tensioning system in a manufacturing process, the system comprising:

a tensioning device, the tensioning device comprising:

(1) a longitudinal position movement mechanism, wherein the longitudinal position movement mechanism is configured to adjust a position of a roll of a material between a first position and a second position in a longitudinal direction of the system that corresponds with a material flow direction;

(2) a material sag sensor, the material sag senor configured to determine an amount of the material between the roll and a processing station in the longitudinal direction;

(3) a roll rotator, the roll rotator configured to rotate the roll about an axis perpendicular to the material flow direction, wherein a rotational velocity of the roll rotator is adjustable based on information from the material sag sensor to maintain a nadir distance range for the material extending between the roll and the processing station;

(4) an apron nozzle, the apron nozzle configured to dispense pressurized air at the roll to form an apron of the material; and (5) an apron sensor, the apron sensor configured to detect an apron of the material, wherein the apron sensor provides information useable to control the pressurized air dispensed by the apron nozzle.

2. The material tensioning system of claim 1 further comprising:

a material storage retrieval ("MSR") system; and a shuttle, wherein the shuttle is positioned between the MSR and the tensioning device in the material flow direction.

3. The material tensioning system of claim 2, wherein the shuttle is comprised of a movement mechanism effective to move the shuttle between the MSR and the tensioning device, the shuttle is configured to transfer the roll between the MSR and the tensioning device.

4. The material tensioning system of claim 2 further comprising:

a processing station, the processing station positioned after the MSR, the shuttle, and the tensioning device in the material flow direction, wherein the processing station is configured to perform a process on the material.

5. The material tensioning system of claim 1 wherein the tensioning device further comprises a vertical movement mechanism, wherein the vertical movement mechanism is configured to raise and lower the roll.

6. The material tensioning system of claim 5, wherein the first position includes the roll vertically above and longitudinally proximate to the processing station and the second position includes the roll at a position having a greater longitudinal separation from the processing station than the first position.

7. The material tensioning system of claim 1 further comprising:

a first roller, the first roller positioned after the roll in the material flow direction; and a second roller, the second roller positioned between the roll and the processing station.

8. The material tensioning system of claim 7, wherein the material is not supported between the roll and the second roller allowing for the material to sag between the roll and the second roller.

9. The material tensioning system of claim 7, wherein the material sag sensor is positioned between the roll and the second roller in the material flow direction and measures a nadir distance of the material to sag between the roll and the second roller.

10. The material tensioning system of claim 1 further comprising a roll diameter sensor, wherein the roll diameter sensor is configured to determine a diameter of the roll.

11. A material tensioning system in a manufacturing process, the system comprising:

a tensioning device, the tensioning device comprising:

a longitudinal position movement mechanism, wherein the longitudinal position movement mechanism is configured to adjust a position of a roll of a material between a first position and a second position in a longitudinal direction of the system that corresponds with a material flow direction;

a vertical position movement mechanism, wherein the vertical position movement mechanism is configured to adjust a position of the roll of the material at the first position and the second position;

a material sag sensor, the material sag senor configured to determine a nadir distance of the material between the roll and a processing station in the longitudinal direction;

a roll rotator, the roll rotator configured to rotate the roll about an axis perpendicular to the material flow direction, wherein a rotational velocity of the roll rotator is adjustable based on information from the material sag sensor to maintain a nadir distance range for the material extending between the roll and the processing station;

an apron nozzle, the apron nozzle configured to dispense pressurized air at the roll to form an apron of the material; and an apron sensor, the apron sensor configured to detect an apron of the material, wherein the apron sensor provides information useable to control the pressurized air dispensed by the apron nozzle;

a material storage retrieval ("MSR") system;

a shuttle, wherein the shuttle is positioned between the MSR and the tensioning device in the material flow direction;

the processing station, wherein the roll transfers between the MSR system, the shuttle, and the tensioning device to feed the material within a defined tension range to the processing station with a sag portion of the material extending between the roll and the processing station.

* * * * *